US008162630B2

(12) United States Patent
Platt

(10) Patent No.: US 8,162,630 B2
(45) Date of Patent: Apr. 24, 2012

(54) ROTARY PUMP WITH COAXIAL MAGNETIC COUPLING

(75) Inventor: Werner Platt, Duisburg (DE)

(73) Assignee: H. Wernert & Co. OHG, Mulheim An Dur Ruhr (DE)

( * ) Notice: Subject to any disclaimer, the term of this patent is extended or adjusted under 35 U.S.C. 154(b) by 832 days.

(21) Appl. No.: 12/295,350

(22) PCT Filed: Mar. 29, 2007

(86) PCT No.: PCT/EP2007/002814

§ 371 (c)(1),
(2), (4) Date: Sep. 30, 2008

(87) PCT Pub. No.: WO2007/112938

PCT Pub. Date: Oct. 11, 2007

(65) Prior Publication Data

US 2010/0028176 A1 Feb. 4, 2010

(30) Foreign Application Priority Data

Mar. 31, 2006 (DE) ..... 20 2006 005 189 U

(51) Int. Cl.
*F04B 17/00* (2006.01)

(52) U.S. Cl. ..... 417/420

(58) Field of Classification Search ..... 417/420, 417/353; 415/10

See application file for complete search history.

(56) References Cited

U.S. PATENT DOCUMENTS

| | | | |
|---|---|---|---|
| 4,645,433 | A | 2/1987 | Hauenstein |
| 4,648,808 | A | 3/1987 | Hauenstein |
| 5,253,986 | A | 10/1993 | Bond et al. |
| 5,501,582 | A | 3/1996 | Gautier et al. |

FOREIGN PATENT DOCUMENTS

| | | | |
|---|---|---|---|
| DE | 1 453 760 | | 1/1969 |
| DE | 298 22 717 | U1 | 12/1998 |
| EP | 0171514 | B1 | 3/1988 |

(Continued)

OTHER PUBLICATIONS

International Search Report, PCT/EP2007/002814.

(Continued)

*Primary Examiner* — Toan Ton
*Assistant Examiner* — Andrew Coughlin
(74) *Attorney, Agent, or Firm* — Fay Sharpe LLP

(57) ABSTRACT

The invention relates to a magnetic coupling pump, with the motor-driven part of the magnetic coupling lying radially inward and the radially outward part of the coupling, together with the pump rotor, having a floating fit in the pumped fluid such that the rotating part of the floating bearing is also radially arranged over the outer magnets. The wall of the pump housing can itself be embodied as the stationary part of the floating bearing with the possibility of direct external access (lubrication, sensor mechanism) and an effective convectional cooling. Dry running on operational faults can be avoided by means of the floating bearing arranged far to the outside, as the damaging gas fraction collects in the radial interior of the pump and remaining traces of liquid are continuously driven outwards and thus contribute to bearing lubrication. By means of an additional annular barrier, the loss of residual fluid can be prevented. The disclosed novel floating bearing permits a large volume separating case which itself permits components of the roller bearings of the motor-driven magnetic coupling section so much installation space that the axial installation length of the complete pump can be significantly shortened.

28 Claims, 8 Drawing Sheets

FOREIGN PATENT DOCUMENTS

| | | |
|---|---|---|
| FR | 2 311 201 | 12/1976 |
| GB | 2 263 312 A | 7/1993 |

OTHER PUBLICATIONS

Wernert-Pumpen, "Standard Plastic Pump with Magnetic Coupling for Use in the Chemical Industry", type series NM, Edition 687/02.

Iwaki, "Magnetic Drive Pumps", Series MDM, printed in Japan 99.11, ITN.

CP Pumpen AG CH-4800 Zofingen, Magnetic drive pump MKP, metallic.

Robert Neumaier, Hermetic pumps, VerlagundBildarchivW.H Faragallah, 1994 ISBN-3-929682-05-2, Chapter 3.7.12 "Shaft-less magnetic coupling rotary pumps", pp. 3S6ff.

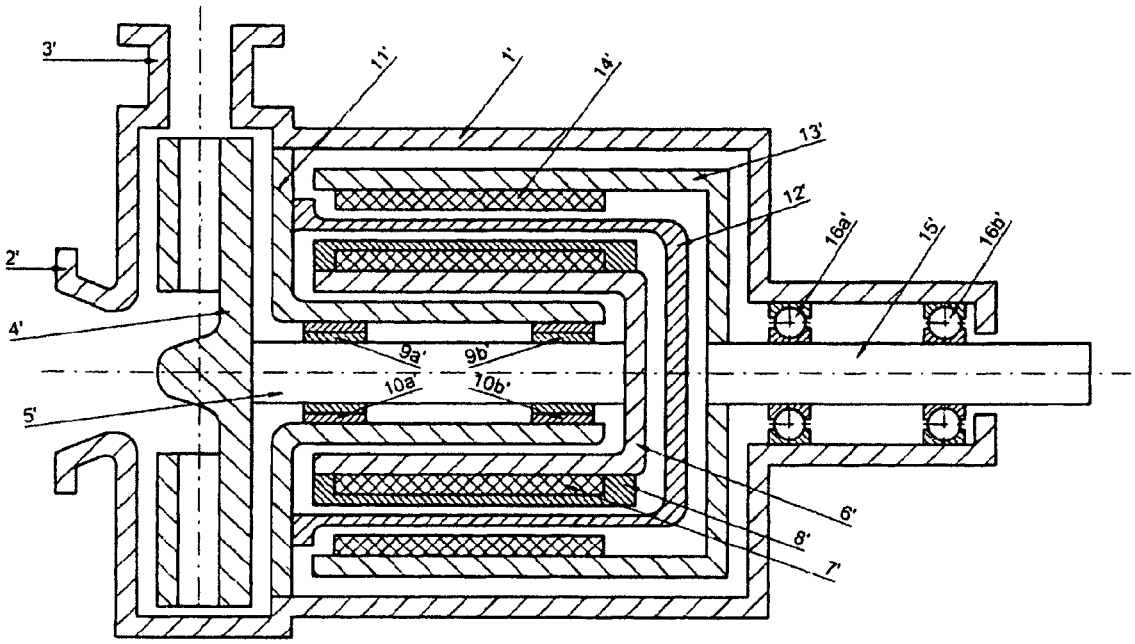
Figure 1 (State of the art)
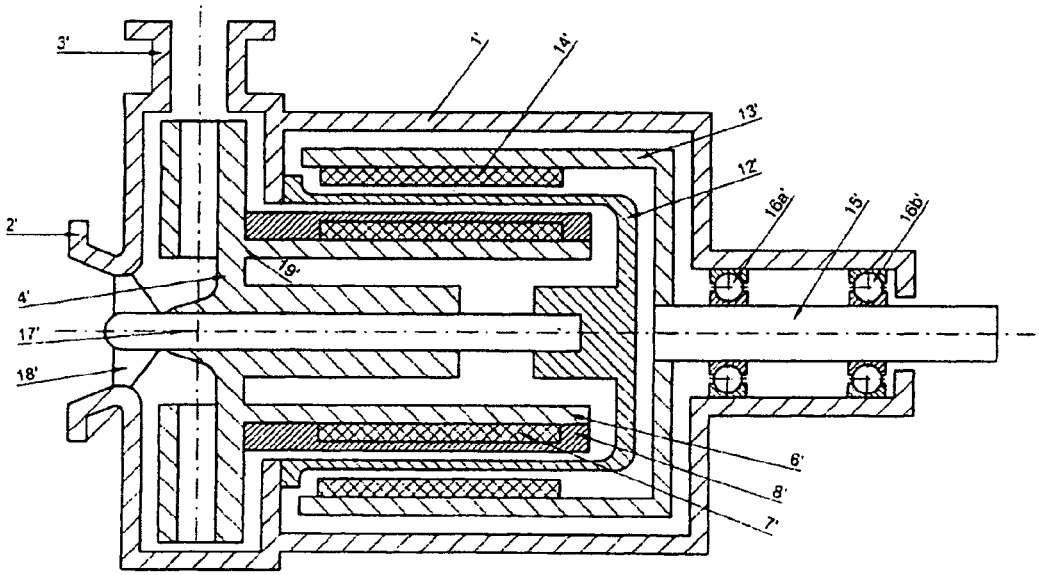
Figure 2 (State of the art)

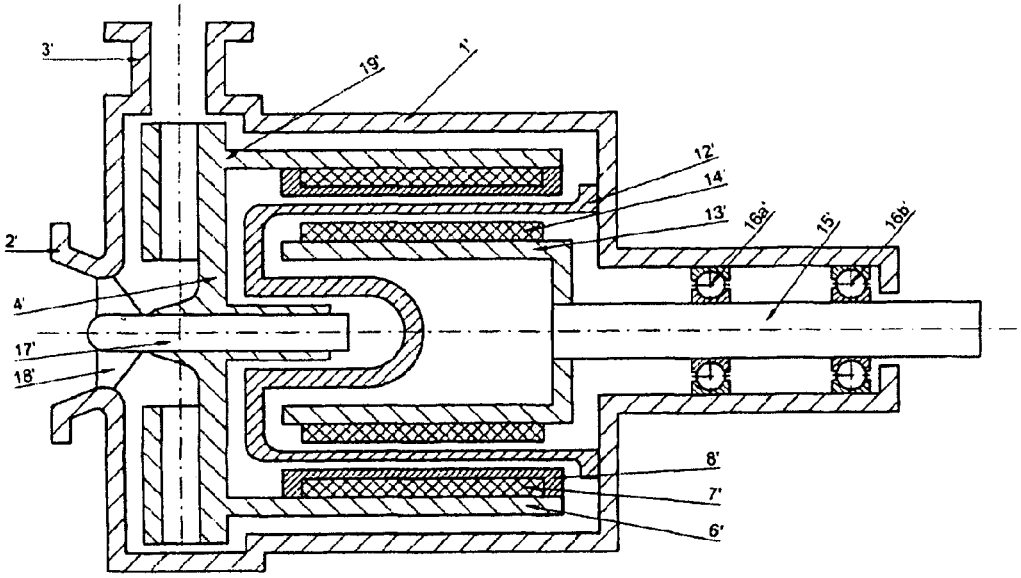
Figure 3 (State of the art)
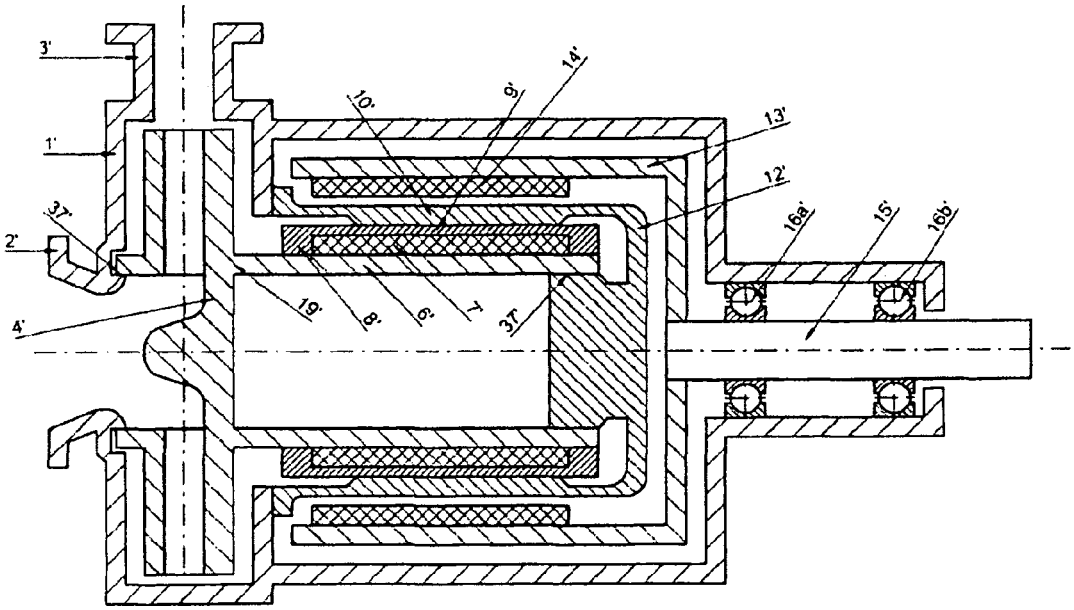
Figure 4 (State of the art)

ROTARY PUMP WITH COAXIAL MAGNETIC COUPLING

CROSS-REFERENCE TO RELATED APPLICATIONS

This application is a national stage entry of international application number PCT/EP2007/002814, having international filing date Mar. 29, 2007, which was not published in English, which claims priority to German patent application number DE202006005189.9, filed Mar. 31, 2006, the entirety of which are hereby incorporated by reference.

FIELD OF THE INVENTION

The invention relates to a rotary pump with the features of the preamble of claim 1, as is known from EP-B1-0171515.

BACKGROUND

Rotary pumps with a magnetic coupling represent an important type of machine used industrially for delivering liquids. Relative to simpler rotary pumps with a floating ring seal, they have the advantage of a hermetic seal of the pumping space. This can appear to be favorable, especially for delivering aggressive or toxic liquids.

In most cases, coaxial rotating couplings with a radial arrangement of the magnets and corresponding radial magnetic active lines are used. Only this construction will be further considered below and is also the subject matter of the application.

The background of the invention will be explained below with reference to FIGS. 1-4 for solutions known to the state of the art.

All of the drawings show an axially longitudinal section through the pump. The rotational bodies sectioned here, for the most part, were shown without peripheral edges for the sake of clarity—with the exception of shafts.

For reasons of assembly and the different materials used, the component designated below as a pump housing (1) must be built, in practice, from several parts. A few of these are wetted by the pumped liquid and must be sealed accordingly, others need not be. However, for reasons of simpler representation, the pump housing (1) is here shown as one part.

A first known pump in a typical construction is shown in FIG. 1 and is advertised, e.g., in the brochure of the company WERNERT-PUMPEN GMBH D-45476 Mulheim am der Ruhr, Standard chemical pump made from plastic with magnetic coupling-model series NM Edition 687/02 (hereinafter "[1]"), incorporated herein by reference in its entirety.

In the pump housing (1') a rotating pump blade wheel (4') is arranged that receives the pumped liquid via the suction port (2') and that ejects it again via the pressure port (3') under the buildup of pressure.

The radial mounting of the pump blade wheel (4') is realized by means of a blade wheel shaft (5') typically in floating bearings (9',10') whose stationary parts are held in a bearing insert (11'). The pumped liquid provides the lubrication and cooling of the floating bearing (9', 10').

The axial mounting of the pump blade wheel (4') and the other parts connected and rotating with the blade wheel are not considered in more detail here or below. Here, all that is indicated is that, in addition to a mechanical mounting with start-up disks, hydraulic active principles, which are based on pressure differences, as well as a magnetic mounting, can come into consideration.

The part of the rotating coupling that receives the torque through a separating wall typically constructed as a thin-walled, slotted pot (12') and that transfers the torque via the blade wheel shaft (5') to the pump blade wheel (4') is designated as a magnetic rotor (6'). It is equipped with permanent magnets (7') which, in turn, must be surrounded in a liquid-tight way with a cylindrical protective sleeve (8') before the corrosive and possibly also abrasive attack of pumping liquid. Here, it is mentioned only as an aside that it may also be necessary to protect an approximately metallic, that is, ferromagnetic, magnetic rotor (6') from corrosion, as well as the shaft (5').

The part of the rotary coupling that receives and transfers the driving torque of the motor via the drive shaft (15') is typically designated as the magnetic driver (13'). It is also equipped accordingly with permanent magnets (14') that rotate in the air and that are therefore not subjected to special attack. The radial and axial bearing of the magnetic driver is realized in conventional roller bearings (16').

FIG. 2 shows another typical construction, in particular, for smaller pumps. Such a pump is advertised, e.g., in the brochure of the company IWAKI Pumpen, Iwaki magnet-driven pumps-series MDM printed in Japan 99.11.UN (hereinafter "[2]"), incorporated herein by reference in its entirety.

In this construction, a bearing insert (11') can be omitted cost-effectively. The pump blade wheel (4') is integrally assembled with the magnetic rotor (6'), the permanent magnets (7'), and the protective sleeve (8') as a single part. This rotating blade wheel-magnet rotor unit (19') is here mounted with a floating fit on a stationary axle (17'). The axle (17') itself is fixed on one side by means of flow ribs (18') in the suction port (2') and is supported on the other side in the specially shaped slotted pot (12').

The construction described in FIGS. 1 and 2 and largely typical today (here designated as construction type A) is characterized in that the magnetic driver (13') is arranged radially outward above the magnetic rotor (6') lying farther inward. This construction has the advantage that the large mass moment of inertia of the outer magnetic driver (13') counteracts the all-too-fast acceleration of the driving motor and thus the breakaway of the magnetic coupling can be prevented more favorably. In addition, this construction simplifies, in particular, a wide, axially spaced radial mounting of the pump blade wheel (4'), which is always a goal due to the large hydraulic forces within the pump.

More rare are magnetic coupling pumps with, in contrast, a radially outward magnetic rotor (6') that are not in contact liquid and an inner lying magnetic driver (13'). Let this construction be designated as construction type B.

Such pumps of construction type B, which are described, e.g., in DE 01453760 or EP 0171514 or EP 0171515 and which are shown in FIG. 3, must be designed with care such that for fast acceleration, the magnetic coupling does not break away, which is a risk here due to the outward lying magnetic rotor (6'). In addition, the radially inwardly lying magnetic driver (13') prevents an axially extended inner floating bearing of the blade wheel-magnetic rotor unit (19'), if the slotted pot (12'), which must face the drive side of the pump with its actual opening in construction type B, is not constructed disadvantageously twisted to the right. A realized pump of construction type B is advertised in the brochure of the company CP-Pumpen AG, CH-4800 Zofingen: Magnetic coupling pump MKP7, metallic (hereinafter "[3]"), incorporated herein by reference in its entirety and is used as a model for FIG. 3. Because here, in contrast to the construction corresponding to FIG. 2, the axle (17') is fixed exclusively by the flow ribs (18'), the realized pump has the advantage of a continuous, thin-walled slotted pot (12') which is loaded only with the internal pressure of the pump, but not with bearing forces, Similar to pumps constructed according to DE 01453760 or EP 0171514, according to U.S. Pat. No. 5,501, 582 A and DE 298 22 717 UI, indeed, in addition to a direct radial bearing of the pump blade wheel, there is also a floating bearing on the outside of the magnetic rotor, but the radially farther inwardly lying bearing on the pump blade wheel leads to the known dry-running problems and jamming of the pump blade wheel and also high wear susceptibility and unfavorable synchronization properties of the blade wheel-magnetic rotor unit.

An important problem area in the operation of the above-mentioned magnetic pumps, which are provided with floating bearings and which use the pumped medium itself as its cooling and lubricating medium, is the near or complete absence of even this liquid. Such a lack of lubrication occurs when higher gas fractions collect in the liquid, e.g., due to cavitation in front of the pump, vortex entry, or by a sipping process. These gas fractions collect in the radially inner hollow spaces of the pump body due to the centrifugal effect in the pump. In the conventional construction according to FIGS. 1-3 and according to U.S. Pat. No. 5,501,582 AI and also DE 298 22 717 U1, however, this is precisely the location of the floating bearings, which then dry out and which are therefore frequently destroyed. However, these solutions often remain bound to the tribology of the friction partners-paired with the attempt to reduce the friction power of the bearing for the lack of lubrication and thus to avoid thermal destruction.

A technically different and very useful way to displace, namely, the floating bearing susceptible to damage, as radially far outward as possible, the approach to the solution features a "shaft-less" magnetic pump as described in Robert Neumaier: Hermetic pumps Verlag und Bildarchiv WJBL Faragallah, 1994, ISBN-3-929682-05-2, Chapter 3.7.12 Shaft-less magnetic coupling rotary pumps, pp. 356ff (hereinafter "[4]"), incorporated herein by reference in its entirety, which is shown in FIG. 4. This construction is assigned to construction type A. Here, it is possible to achieve a shaft-less and axle-less construction, in that a section of the slotted pot (12') is used as the stationary part (10') of the floating bearing and the rotating part (9') of the floating bearing is formed by a section of the protective sleeve (8'). The pump blade wheel (4') is connected to the magnetic rotor (6') the permanent magnet (7') and the protective sleeve (8') to form a hollow blade wheel-magnetic rotor unit (19').

Nevertheless, the proposal from [4] remains technically limited. For example, the radial floating bearing of the blade wheel-magnetic rotor unit (19') is realized in the slotted pot (12') itself, which, however, must be constructed directly at this point as a very thin-walled component. This is also noted in [4], and therefore stable, additional start-up or emergency bearings (37') which must always be formed disadvantageously due to the slotted pot (12') can also not be eliminated there. Furthermore, the support of the bearing in the thin-walled slotted pot does not permit outer cooling or simple outer access, for example, for monitoring the bearing temperature or for forced flushing.

It remains to be stated that in the case of an operational interruption, e.g., due to cavitation in front of the pump, vortex entry or by a sipping process, a rotary pump is loaded with significantly increased gas fractions in the pumped liquid. These gas fractions collect due to the centrifugal effect in the pump in the radially inner hollow spaces of the pump body. For conventional magnetic coupling pumps, the floating bearings are located there, thus they dry out and therefore are frequently destroyed.

SUMMARY

The invention is based on the problem of improving the radial bearing in the region of the magnetic coupling of a rotary pump according to the class. For solving this problem, a rotary pump is proposed with a pump housing providing a static and closed enclosure of pumping liquid in an interior of the pump, a contact-less, permanent-magnet, coaxial rotary coupling for transmitting a drive moment into the interior of the pump housing, a pump blade wheel that forms, together with a magnetic rotor carrying permanent magnets, a pot-shaped component supported by floating bearings and open toward a drive side, wherein magnetic field lines of a driving part of the rotary coupling point radially outward and wherein magnetic field lines of a part of the rotary coupling connected to the pump blade wheel point radially inward, wherein for a radial support of the pot-shaped component, and wherein a rotating part of a floating bearing is arranged along an outer periphery of the magnetic rotor and is rigidly connected to the rotor or is formed by the outer periphery or sections of the outer periphery of the magnetic rotor itself. comprising a plurality of floating bearing sections spaced apart axially from one another and being located at approximately the same radial level.

By means of the invention, which overcomes the above-described imperfections of the state of the art and in which the radial bearing of the blade wheel-magnetic rotor unit is displaced as far outwardly as possible the following advantages, among others, are achieved; the bearing of the blade wheel-magnetic rotor unit continues to operate reliably in the case of an operational interruption on the end of the gas inlet outside of the inner region susceptible to damage, wherein favorably residual liquid is also centrifuged outward and is then used for lubricating the bearing; the bearing is located close to the outer housing wall, where the residual liquid that is centrifuged outwardly and that for example, heats up, can be effectively cooled by means of cooling ribs; a comparatively high floating speed is achieved in the bearings, so that, despite the typically low pump rotational speeds (as a rule, only 1000-3000 rpm), the bearing can be led into the state of contact-free floating that is fit even for low pumping-medium viscosities (often similar to water), and thus the mixed friction region of conventional floating bearings in magnetic coupling pumps is avoided; a simple outer access to the floating bearings is possible and thus the possibility of externally fed bearing lubrication and/or monitoring by sensors of the bearing is created; the slotted pot is no longer used as a supporting component, so that, subordinate to the magnetic moment transmission, it can always have a thin-walled construction and yet there is no risk of overloading or deformation; and startup and emergency bearings can be eliminated.

If the stationary part of the floating bearing is arranged as a whole on the inner-side wall surface of the pump housing or is independently formed by the housing wall or sections of the housing wall of the pump housing on a large axial length, as a whole, high radial bearing forces can be transmitted and smooth synchronization of the blade wheel-magnetic rotor unit can be achieved. In the case of several floating bearing sections spaced apart axially, these are advantageously located at approximately the same radial level in order to further improve the synchronization properties and the dry-running capacity of the bearing. In principle, in the sense of the invention it is possible to also support the pump blade wheel as such, in particular, for receiving axial bearing forces. In addition, radial bearing forces can also be received on the pump blade wheel, e.g., in order to achieve an improvement of the emergency running and/or start-up properties. The best synchronization conditions are achieved, however, when the pump blade wheel can be rotated radially without contact or force.

If a liquid retention space is provided in the region of the floating bearing of the blade wheel-magnetic rotor unit, the risk of dry running is reduced.

If the floating bearing of the blade wheel-magnetic rotor unit is constructed in its rotating part as a continuous sleeve, optionally in the shape of a molded mass, the best possible material pairings and protection of the permanent magnet of the magnetic rotor can be improved and simplified.

If the rotating part of the floating bearing of the blade wheel-magnetic rotor unit has recesses or elevations on its outer periphery, liquid movements that improve the floating properties can be generated.

If the outer walls of the pump housing are provided with cooling ribs or a cooling sleeve in the region of the stationary part of the floating bearing of the blade wheel-magnetic rotor unit, bearing damage due to overheating can be avoided.

If accesses for external lubricant or monitoring sensors are provided in the walls of the pump housing in the region of the stationary part of the floating bearing of the blade wheel-magnetic rotor unit, this floating bearing can be provided with lubrication or emergency lubrication or it can be inspected for wear.

If the pump housing walls have a multilayer construction and the innermost material layer is made from a corrosion-resistant or abrasion-resistant material, the longevity can be improved also for difficult pumping media.

The previously mentioned constructions of a rotary pump are also of standalone, inventive significance independently of claim 1.

If the magnetic driver has available at least one bearing arranged in the region of the inner space of the blade wheel-magnetic rotor unit, the structural length of the pump can be considerably shortened despite the standalone bearing of the magnetic driver within the pump. For the magnetic driver bearing, preferably roller bearings are used. The roller bearing of the magnetic driver remains untouched by the pumping liquid. For this purpose, advantageously a known slotted pot is used, which is arranged between the magnetic rotor and the magnetic driver. The magnetic driver advantageously has a pot shape that is open toward the drive side, in order to hold the one or more bearings of the magnetic rotorwithin the pump housing. An especially advantageous bearing of the magnetic driver is achieved by a continuous, hollow collar journal, through which the drive shaft of the magnetic driver is guided and which carries, advantageously at one or more inner or outer surfaces at one or more of its end regions, a bearing for the magnetic driver. Tapering in these end regions simplifies the housing of such bearings in a small space. If the tapering is realized starting from the base of the collar journal, high bearing forces can be held for a lightweight construction.

The at least partial support of the magnetic driver within the space spanned by the blade wheel-magnetic rotor unit, as well as the constructions of such a bearing, are of standalone, inventive significance.

The components mentioned above and also claimed and to be used according to the invention as described in the embodiments have no particular restriction in terms of size, shape, material selection, or technical design, so that the selection criteria known in the field of use can be applied without restriction.

BRIEF DESCRIPTION OF THE DRAWINGS

Additional details, features, and advantages of the subject matter of the invention follow from the subordinate claims and also from the following description of the associated drawings, in which, as an example, a preferred embodiment of the arrangement according to the invention for a rotary pump is shown with a coaxial magnetic coupling. Shown in the drawings are:

FIGS. 1-4 are axial sectional views of prior art pumps;

DETAILED DESCRIPTION OF THE INVENTION

Figure 5:
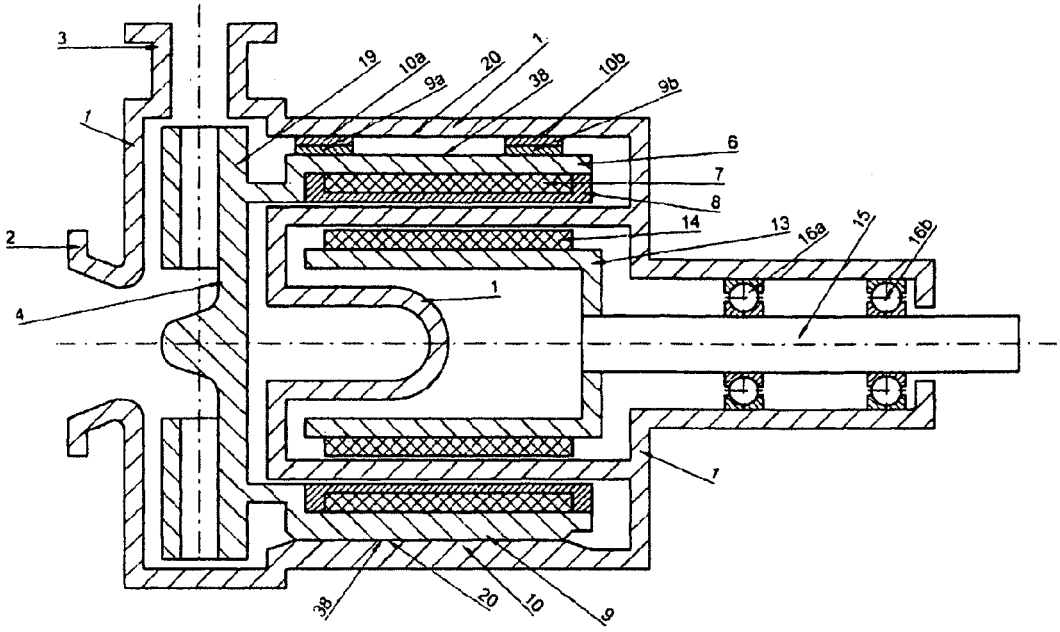
FIG. 5, a first embodiment of a rotary pump according to the invention in an axial section in schematic form.

All embodiments have a pump housing 1 with a suction port 2 and a pressure port 3, wherein a pump blade wheel 4 is mounted coaxial to the suction port and is fluidically connected to the pressure port 3 in the radial direction. The pump blade wheel 4 has, on the drive side, a magnetic rotor 6, with which it forms a blade wheel-magnetic rotor unit that is open toward the drive side. On its outer periphery, this unit has the rotating part 9 of a floating bearing, while the stationary part 10 of this floating bearing is arranged on the inner wall 20 of the pump housing 1. On the radial inside, the magnetic rotor 6 carries permanent magnets 7. These stand opposite permanent magnets 14 with a radial distance and these magnets are arranged on the outer surface of an approximately pot-shaped magnetic driver 13. Between the magnetic rotor and the magnetic driver there is a separating wall in all embodiments, optionally in the shape of a so-called slotted pot 12, with this wall keeping the magnetic driver dry relative to the liquid-wetted interior of the pump. The magnetic driver 13 is supported at two positions spaced apart axially by means of roller bearings 16*a* and 16*b*. This support is realized in all of the embodiments-even if not absolutely necessary-opposite the pump housing 1, wherein this support is realized in the embodiments according to FIGS. 7-15 at least on the pump side within the space formed by the blade wheel-magnetic rotor unit 19. For this purpose, a continuous, hollow collar journal 39 projects from the drive-side housing end wall to the pump side and has a tapering structural shape 39*a*, 39*b*, wherein, on its drive-side end region, the drive shaft 15 of the pump penetrating this hollow collar journal is supported by rollers, while a second roller bearing indirectly supports, in the opposite end region on its outer side, the drive shaft 15, namely by means of the magnetic driver 13. For this purpose, the latter has a pot shape that is open on the drive side.

The outer periphery of the blade wheel-magnetic rotor unit 19 can now be used—with complete freedom of shape and in wide axial extent—for holding the rotating part 9 of the floating bearing (FIG. 5, upper half) and need not be, as in the state of the art according to FIG. 4, the protective sleeve 8 with the thinnest walls possible for economical reasons. In [4] this also led to requirements for additional radial start-up and emergency bearings 37, which are no longer needed here for any reason. It is even possible, with suitable selection of the material and corresponding shaping, to use parts of the magnetic rotor 6 themselves for the rotating part 9 of the floating bearing (FIG. 5, lower half). However, if the magnetic rotor 6 is not suitable because its material, as a rule, must be ferromagnetic, then a suitable technical solution is offered by Claims 3 and 4, as will be seen. This is subordinate to claim 1 because the inserted protection (sleeve 29 or shaped mass 30) for the magnetic rotor 6 is finally also part of the blade wheel-magnetic rotor unit 19.

Because all of the parts of the coaxial magnetic coupling are placed radially farther inward, the stationary part 10 of the floating bearing can be guided, without additional means, directly onto the stable, inner housing wall 20 of the pump housing 1 (FIG. 5, upper half) and no longer has to be disadvantageously the main thin wall of the slotted pot 12, as, described in [4]. It is even possible, with suitable selection of the material and for corresponding shaping, to use parts of the housing walls 20 of the pump housing 1 itself for the stationary part of the floating bearing 10 (FIG. 5, lower half), optionally also only through a multi-layer construction, as shown later in claim 9.

For an effective floating bearing, it is insignificant here whether support is realized at two explicit bearing positions 9, 10*a*, and 9, 10*b* (FIG. 5, upper half) or whether the entire floating bearing is extended to form a single, axially extended "bearing drum" (FIG. 5, lower half). Combinations are also conceivable, that is, explicit, rotating bearings 9*a* and *b* relative to stationary bearings 10 as an axially extended drum and vice versa.

An arrangement according to claim 1 offers not only considerable technological advantages, but also leads to an extremely simple construction of the entire pump.

Figure 6:
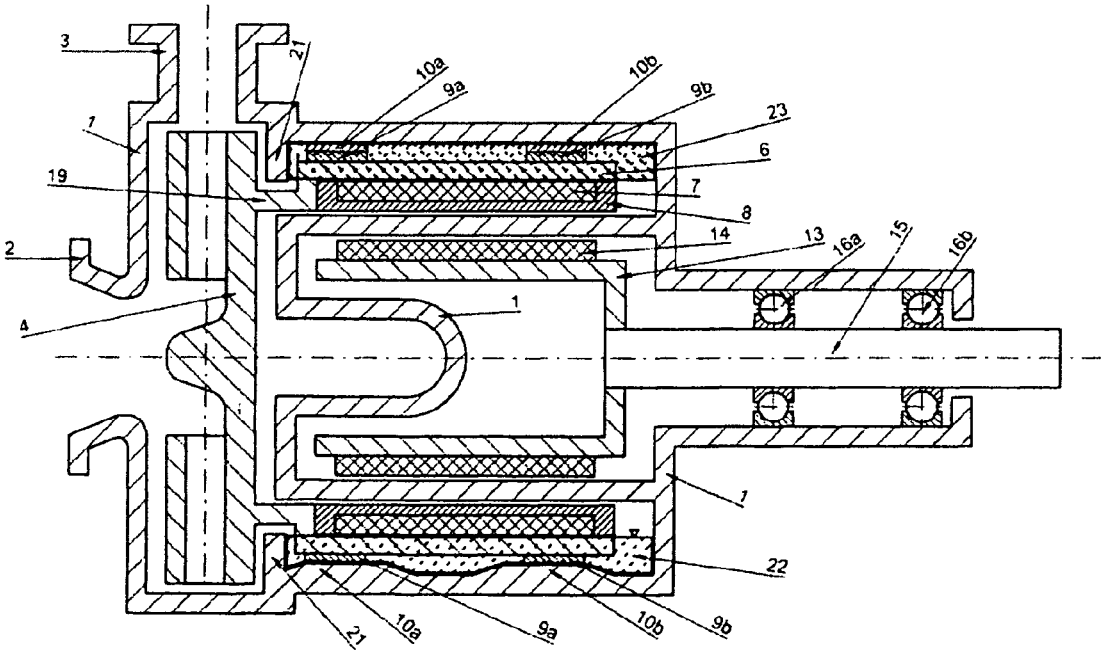
FIG. 6, a second embodiment.

In the case of operational interruptions—which are frequent in practice—in the pump by means of large gas entry (air or vaporized pumping liquid due to cavitation), the residual liquid remaining in the pump collects as a centrifuged ring on the outer periphery in the pump housing 1. For a pump according to claim 1, the floating bearing 9,10 is arranged precisely here, which can be operated for an arbitrary long time with the residual liquid with sufficient cooling. However, for very low residual quantities, which tend to be achieved for large pumping magnitudes of the pump and low static counter pressure, it is not to be excluded that these can escape axially, in order to issue even higher radial levels in the blade wheel. This can be prevented by means of a barrier in the form of a peripheral ring 21, as claim 2 introduces and as shown in FIG. 6, If the inner diameter of the peripheral ring 21 is selected to be smaller than the contact diameter between the floating bearing halves 9 and 10, then the enclosed and rotating liquid ring 23 always wets the floating bearing 9, 10 (FIG. 6, upper half). Another advantage of this construction is given when the pump is at a standstill, namely when the peripheral ring 21 prevents complete emptying of the pump in the region of the floating bearing 9, 10. If the pump is then restarted, without applying liquid to the suction port 2, which is likewise a frequent operational error, then the floating bearing 9, 10 is always sufficiently lubricated with the liquid pattern remaining in the liquid retention space (22) (FIG. 6, lower half) and its axial escape during rotation is also prevented by the barrier.

The invention according to claim 1 can also be used to considerably shorten the axial extent of the pump. This is possible in that the magnetic driver 13 is not supported in the pump housing 17 but instead is placed directly on the shaft journal of the drive machine, that is, is ultimately supported by the drive machine. This drive machine is usually an electric motor. Here, the electric motor is flanged directly to the pump, which is known as a "block construction."

In addition to the effect of axial shortening, the advantage of this construction is the savings of two roller bearings 16. A disadvantage in this construction is that the magnetic driver 13 no longer belongs to the pump and, thus, a complete assembly of the pump can be realized only when the driving motor is also present. At least for industrial pumps, however, its structural size is initially an unknown size and can be determined only on the basis of customer information. Thus, the time for final assembly of the pump is necessarily set after this time and also leads to individual assembly with the known economical disadvantages.

Figure 7:
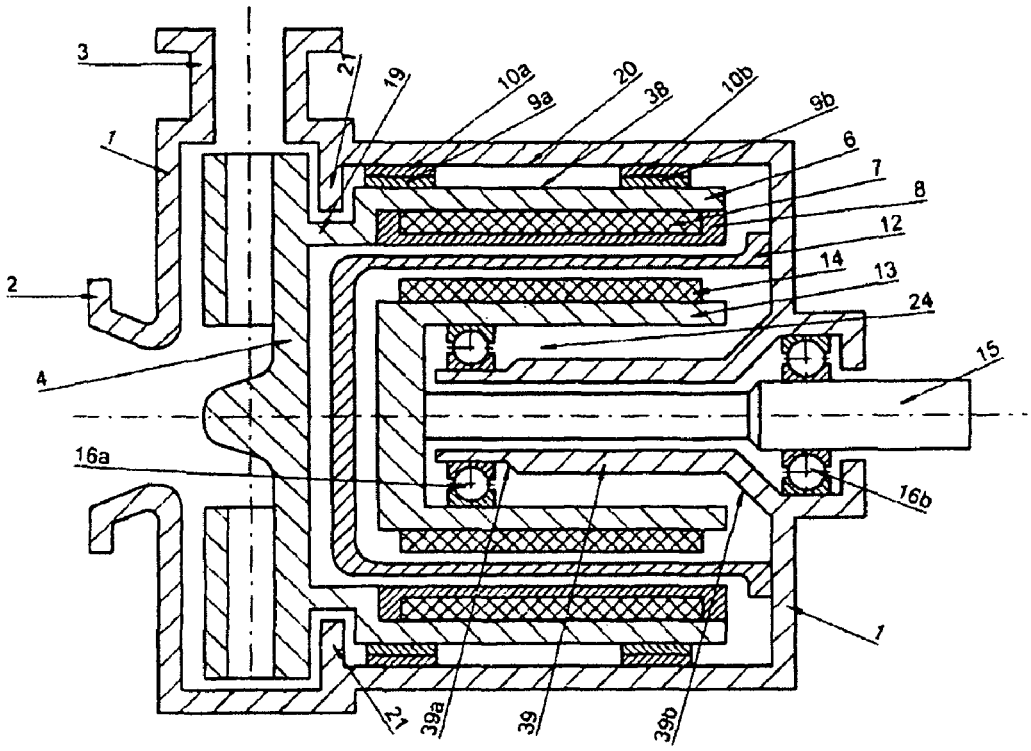
FIG. 7, a third embodiment.
Figure 8:
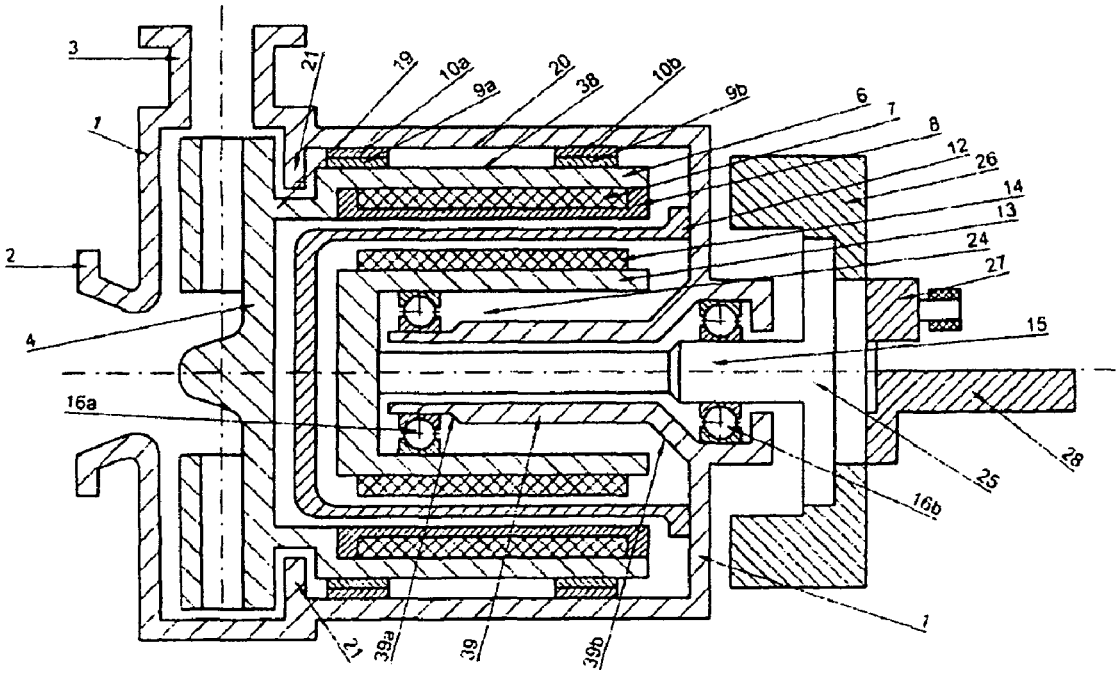
FIG. 8, a fourth embodiment.

In the approach for a better solution according to claim 10 (FIG. 7), initially a slotted pot 12, which is always used in industrial pumps and which is advantageously detachable, is inserted. In practice, these slotted pots have very thin-walled constructions at the periphery, in order to be able to implement the smallest possible radial gap between the magnetic rotor 6 and magnetic driver 13. Due to the construction type according to claim 1, the slotted pot 12 can be constructed with a smooth end wall and must point in the direction of the drive side with its larger opening. Indeed, if the slotted pot 12, due to its thin-walled construction, is not to be used for supporting a roller bearing sufficient space for an axially large roller bearing 16 of the magnetic driver 13 is now available in its inner region 24 according to claim 10 (FIG. 7). Thus, the axial structural mass of the pump can be shortened to that of the conventional block construction, but here the magnetic driver 13 remains a component of the pump, which permits a complete production-line assembly and inventory stocking of the pump.

For such an axially shortened construction, advantageously according to claim 15 or 16 (FIG. 8), the shaft end 25 can be constructed in such a way that the direct connection of a motor (which here could also be flanged directly to the pump by means of an intermediate ring) is possible selectively by means of a conventional pump coupling (only the journal part 27 of the pump coupling is shown), or a shaft journal 28 again leads to the conventional pump with the free shaft end (e.g., to meet given standard dimensions). Also, such a shaft end 25 should provide the possibility of mounting an additional flyweight mass 26 in order to be able to compensate for the mentioned disadvantage of the selected construction type B when the pump starts. All of this would be part of the final assembly of the pump assembly (which also could have been performed by the user of the pumps) and would nevertheless allow a largely production-line assembly and favorable stocking of the pump at the manufacturer, as described above.

Figure 9:
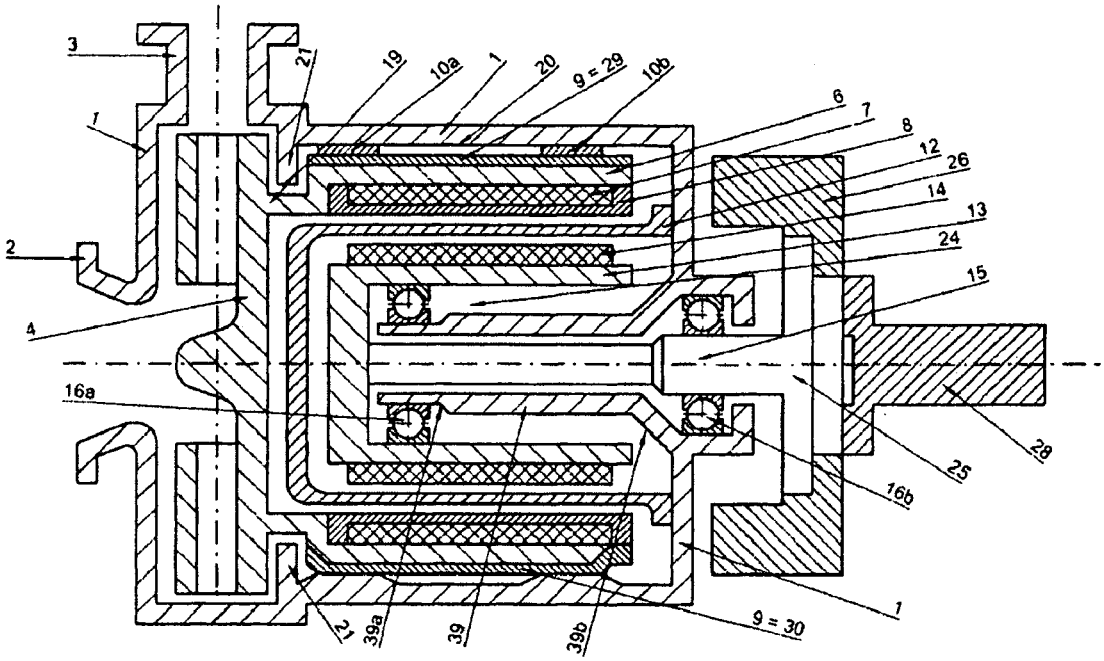
FIG. 9, a fifth embodiment.
Figure 10:
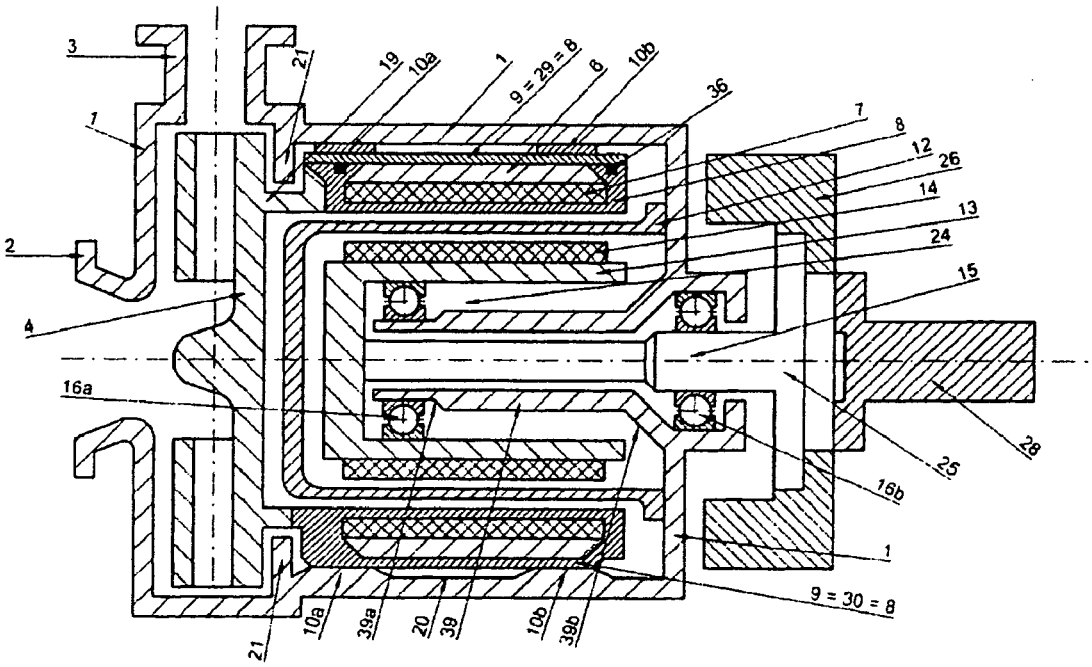
FIG. 10, a sixth embodiment.

The rotating part 9 of the floating bearing does not necessarily have to be made from two defined bearing sleeves a and b or from the magnetic rotor 6 itself, but instead can also be constructed according to claim 3 (FIG. 9) as an axial, continuous sleeve 29 (FIG. 9, upper half) or shaped mass 30 (FIG. 9, lower half).

This offers economical advantages, in particular, when these components are still used according to claim 4 (FIG. 10) for protecting and for sealing the radially deeper magnetic rotor 6 and the permanent magnet 7. According to one field of use, it is completely typical that also the magnetic rotor 6 must be protected as the ferromagnetic carrier of the permanent magnet 7 from the attack of the pumped liquid and may not come into contact with the liquid, like the pump blade wheel (4), for example. The difference in materials between the pump blade wheel (4) and magnetic rotor 6 is represented by different shading.

Figure 11:
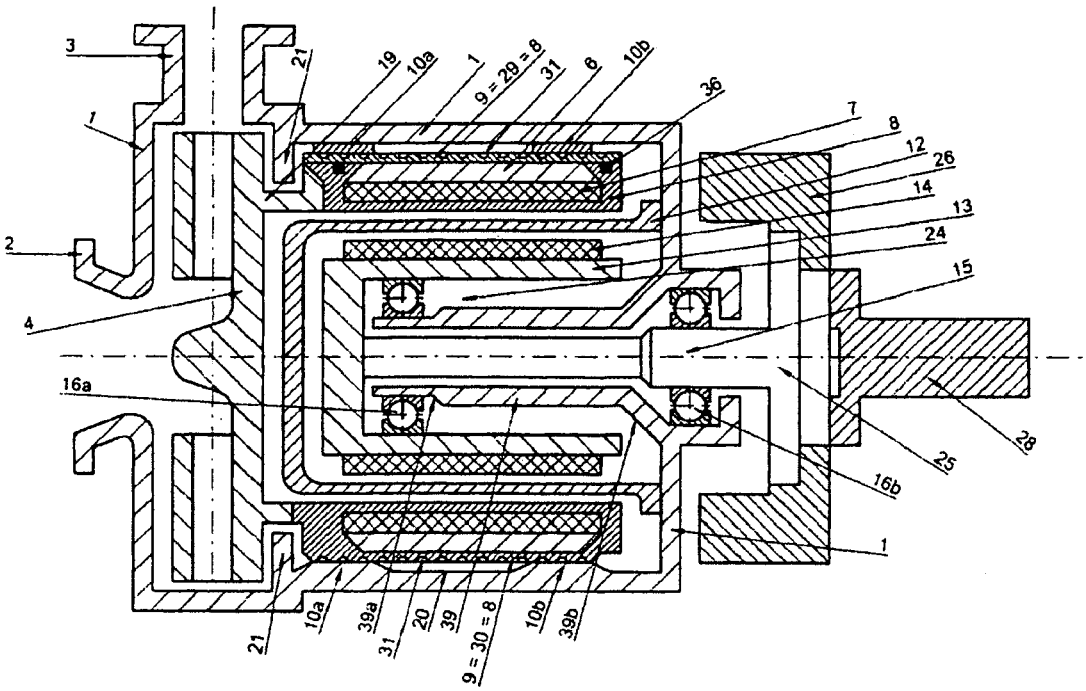
FIG. 11, a seventh embodiment.
Figure 12:
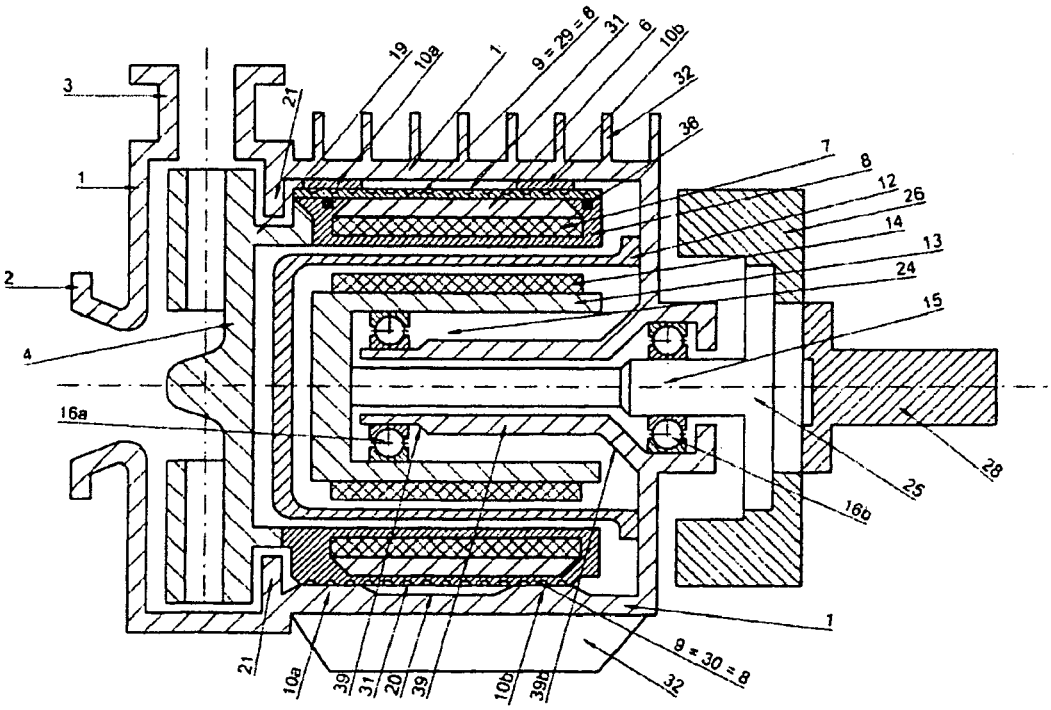
FIG. 12, an eighth embodiment.
Figure 13:
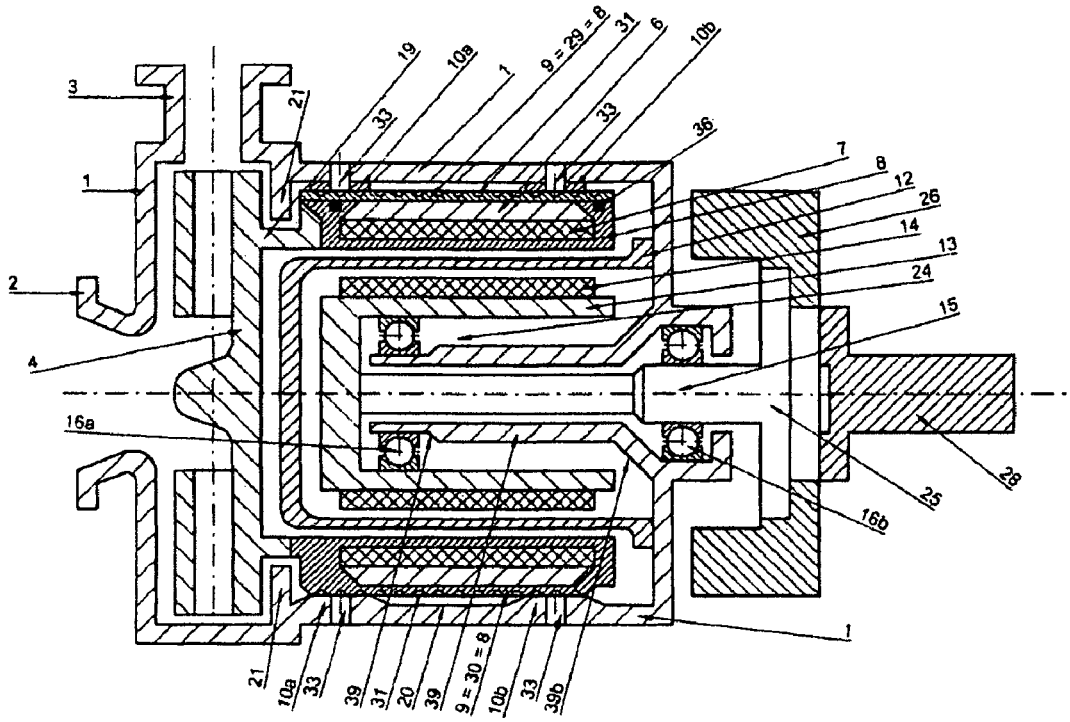
FIG. 13, a ninth embodiment.

The desired completely contact-free, and thus wear-free and low-friction, floating fit of the blade wheel-magnetic rotor system 19 in the pump housing 1 counteracts the high peripheral speed of this arrangement. Through additional dimple-like recesses or elevated sections on the surface of the rotating floating bearing 9, e.g., on the sleeve 29 or the shaped mass 30, so-called Taylor turbulence can be generated in the floating gap and in the adjacent rotational space of the liquid, which contribute to the stabilization and to the contact freedom of the floating bearing. These recesses or elevated sections are introduced with claim 5 (FIG. 11).

In particular, in the pump, in the case of an operational interruption, if only a liquid ring 23 still rotates and there is no flow of fresh lubricant, this residual liquid is heated in the floating bearing due to friction until an equilibrium in terms of heat transport is achieved with the pump housing 1. Due to the direct contact of the floating bearing 9, 10 with the pump housing 1, here through the attachment of outer cooling ribs 32, as introduced in claim 6 (FIG. 12), there is a direct, effective possibility of increased, convective heat transfer and, thus, the reduction of the stationary temperature of the liquid ring 23 for a long-lasting operational interruption. In the upper half of FIG. 12, transverse ribbing is shown, and, in the lower half, there is longitudinal ribbing. This later construction may be more useful in practice, because the otherwise present cooling air flow of the driving electric motor can be used favorably, which is always realized in the direction toward the pump.

Figure 14:
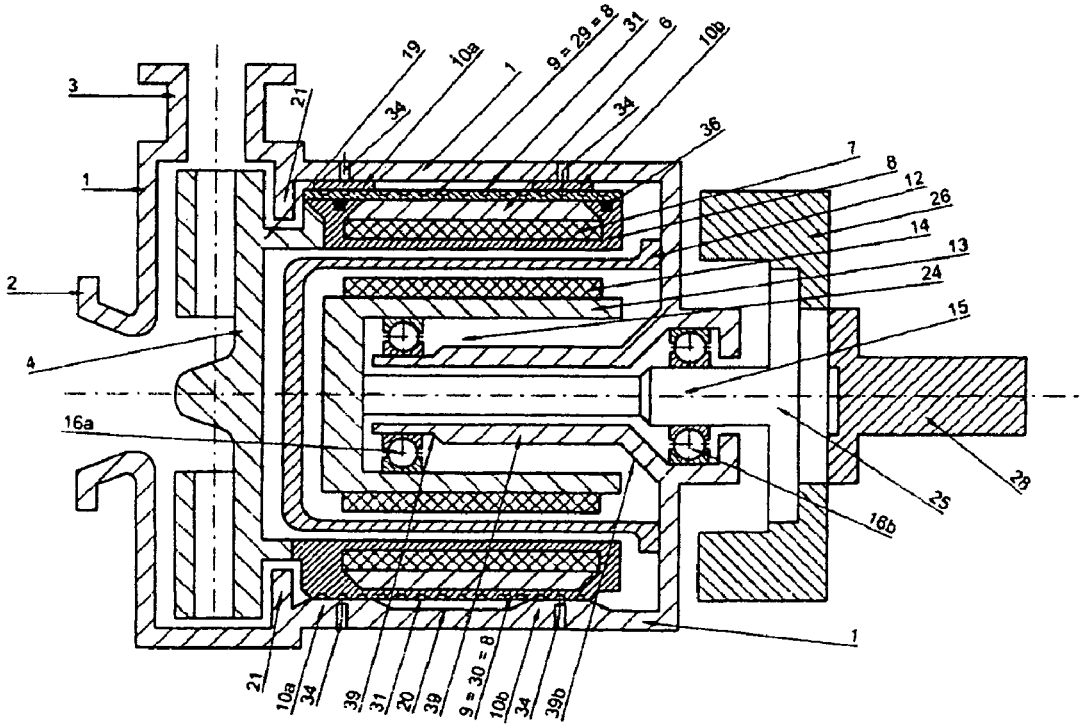
FIG. 14, a tenth embodiment.
Figure 15:
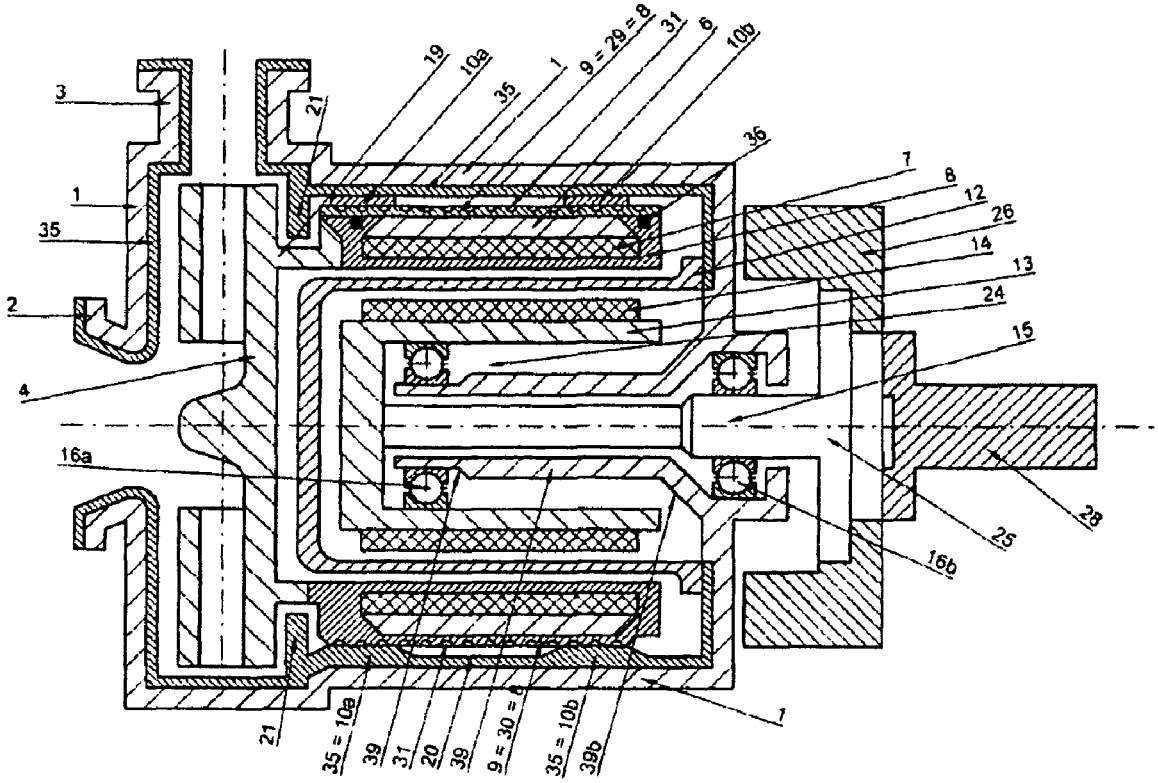
FIG. 15, an eleventh embodiment.

In order to prevent the lack of lubrication of the floating bearing 9, 10 also in the case of a corresponding operational interruption, a supply of external lubricant is proposed according to claim 7 (FIG. 13) and/or monitoring by means of sensors (e.g., temperature, vibration, structure-borne sound) for the floating bearing 9, 10 according to claim 8 (FIG. 14). Here, the vicinity of the floating bearing 9, 10 to the pump housing 1 has the effect that this access can be realized easily.

Many realized magnetic coupling pumps, which are especially well suited due to the hermetic sealing of the pump interior directly for the feeding of more aggressive, abrasive, and dangerous liquids, are covered in the wetted region of the pump housing 1, for example, with a plastic layer, or are constructed from several—as a rule, two—material shells. Ultimately, the innermost material layer 35 must have the desired properties relative to the liquid, while the outer shells are used for the shaping and stability relative to the inner pressure of the pump. claim 9 (FIG. 15) is also valid for this construction for the present invention. Bi particular, because the mentioned plastic materials (e.g., PTEE or PE) can also be used in the mixed-friction region with outstanding results as a floating bearing material, a construction has been proposed as shown in the lower half of FIG. 15. In contrast, if the material of the innermost material layer 35 is not suitable for a floating bearing, the invention reverts to the construction shown in the upper half of FIG. 15.

The invention clamed is:

1. A rotary pump, comprising:

a pump housing providing a static and closed enclosure of pumping liquid in an interior of the pump, a contact-less, permanent-magnet, coaxial rotary coupling for transmitting a drive moment into the interior of the pump housing, a pump blade wheel that forms, together with a magnetic rotor carrying permanent magnets, a pot-shaped component supported by floating bearings and open toward a drive side, wherein magnetic field lines of a driving part of the rotary coupling point radially outward and wherein magnetic field lines of a part of the rotary coupling connected to the pump blade wheel point radially inward, and a plurality of floating bearing sections axially located between the pump blade wheel and the drive side and s aced apart axially from one another to radially support the pot-shaped component, the floating bearing sections each including a rotating part arranged along an outer periphery of the magnetic rotor, the rotating part of each floating bearing section being rigidly connected to the rotor or formed by the outer periphery or sections of the outer periphery of the magnetic rotor.

2. A rotary pump according to claim 1, wherein the floating bearing sections each include a stationary part axially located between the pump blade wheel and the drive side and arranged on an inner wall surface of the pump housing or formed by a housing wall or sections of the housing wall of the pump housing itself.

3. A rotary pump according to claim 1, wherein the plurality of floating bearing sections are located at approximately the same radial level.

4. A rotary pump according to claim 1, wherein the pump blade wheel can rotate radially without contact.

5. A rotary pump according to claim 1, further comprising a peripheral ring or collar arranged between the pump blade wheel and the floating bearing such that inner dimensions of the peripheral ring or collar are smaller than a contact diameter of the floating bearings to maintain a liquid retention space in the region of the floating bearing both when the pump blade wheel is rotating and also when it is at a standstill.

6. A rotary pump according to claim 1, wherein the rotating part of the floating bearing is an axial, continuous sleeve or an axial, continuous, cast or pressed shaped mass.

7. A rotary pump according to claim 6, wherein the sleeve or the shaped mass is mounted, shaped, or sealed with sealing means such that the sleeve or the shaped mass is part of a protective sleeve for the permanent magnet and/or the magnetic rotor.

8. A rotary pump according to claim 1, wherein the rotating part of the floating bearing is provided on its outer periphery with a plurality of local recesses or elevated sections, which promote the production of stabilizing flow turbulence in the floating bearing.

9. A rotary pump according to claim 1, wherein at least one outer wall of the pump housing comprises at least one cooling rib in the region of the stationary part of the floating bearing.

10. A rotary pump according to claim 1, wherein a stationary part of the floating bearing can be supplied with external lubricant through one or more accesses in the walls of the pump housing.

11. A rotary pump according to claim 1, wherein at least one wall of the pump housing comprises one or more accesses to receive sensors to monitor a stationary part of the floating bearing.

12. A rotary pump according to claim 1, wherein at least one wall of the pump housing includes a plurality of material layers with an innermost material layer being made from a corrosion-resistant and/or abrasion-resistant material.

13. A rotary pump according to claim 1, wherein at least one outer wall of the pump housing comprises at least one cooling sleeve in the region of the stationary part of the floating bearing,

14. A rotary pump, comprising:

a pump housing providing a static and closed enclosure of the pumping liquid in an interior of the pump, a contact-less, permanent-magnet, coaxial rotary coupling for transmitting a drive moment into the interior of the pump housing, a pump blade wheel that forms, together with a magnetic rotor carrying permanent magnets, a pot-shaped component open toward a drive side, wherein magnetic field lines of a driving part of the rotary coupling point radially outward and wherein magnetic field lines of a part of the rotary coupling connected to the pump blade wheel point radially inward, a floating bearing comprising a plurality of floating bearing sections axially located between the pump blade wheel and the drive side and spaced apart axially from one another to radially support the pot-shaped component, the floating bearing sections each including a rotating part along an outer periphery of the magnetic rotor and a stationary part along an inner wall surface of the pump housing, a separating wall between the magnetic rotor and the driving part, the separating wall facing a drive side of the pump with its opening, and the separating wall separating liquid in the interior of the pump from the driving part, at least one bearing connected to the pump and supporting the driving part without contact on the separating wall, and at least another bearing on the side of the pump blade wheel and located in an inner region of the pump housing.

15. A rotary pump according to claim 14, wherein one or more bearings on the blade wheel side are located in an inner region of an inner, hollow magnetic driver.

16. A rotary pump according to claim 14, comprising:

an inner ring fixed by the bearing on the blade wheel side, and an associated outer ring that rotates with the supported driving part.

17. A rotary pump according to claim 16, further comprising a roller bearing on the drive side, the roller bearing having the inner ring that rotates with a supported drive shaft, and the associated outer ring that is fixed.

18. A rotary pump according to claim 17, comprising a continuous, hollow collar journal projecting into the pump housing from the drive side for holding the drive shaft, the journal being connected to or capable of being connected to the pump housing.

19. A rotary pump according to claim 18, wherein the hollow collar journal has at least tapering in one of its end regions.

20. A rotary pump according to claim 17, wherein a region of the drive-side end of the drive shaft is constructed so that it can be detachably and selectively connected to a flywheel mass, a journal part of a pump coupling, and/or a shaft journal.

21. A rotary pump according to claim 14, wherein-region of the drive-side end of the drive shaft is constructed so that it has a flywheel mass-or can be provided with a flywheel mass.

22. A rotary pump according to claim 14, wherein the driving part has a pot shape open towards the drive side.

23. A rotary pump according to claim 14, wherein at least one outer wall of the pump housing comprises at least one cooling sleeve in the region of the stationary part of the floating bearing.

24. A rotary pump according to claim 14, wherein the plurality of floating bearing sections are located at approximately the same radial level.

25. A rotary pump according to claim 14, wherein at least one outer wall of the pump housing comprises at least one cooling rib in the region of the stationary part of the floating bearing.

26. A rotary pump, comprising:

a pump housing providing a static and closed enclosure of pumping liquid in an interior of he pump, a contact-less, permanent-magnet, coaxial rotary coupling for transmitting a drive moment into the interior of the pump housing, a pump blade wheel that forms, together with a magnetic rotor carrying permanent magnets, a pot-shaped component supported by floating bearings and open toward a drive side, wherein magnetic field lines of a driving part of the rotary coupling point radially outward and wherein magnetic field lines of a part of the rotary coupling connected to the pump blade wheel point radially inward, and a floating bearing having a rotating part arranged along an outer periphery of the magnetic rotor, the rotating part being rigidly connected to the rotor or formed by the outer periphery or sections of the outer periphery of the magnetic rotor, wherein the rotating part of the floating bearing comprises a plurality of local recesses or elevated sections on its outer periphery, which promote the production of stabilizing flow turbulence in the floating bearing.

27. A rotary pump, comprising:

a pump housing providing a static and closed enclosure of the pumping liquid in an interior of the pump, a contact-less, permanent-magnet, coaxial rotary coupling for transmitting a drive moment into the interior of the pump housing, a pump blade wheel that forms, together with a magnetic rotor carrying permanent magnets, a pot-shaped component supported by floating bearings and-open toward a drive side, wherein magnetic field lines of a driving part of the rotary coupling point radially outward and wherein magnetic field lines of a part of the rotary coupling connected to the pump blade wheel point radially inward, a separating wall between the magnetic rotor and the driving part, the separating wall facing a drive side of the pump with its opening, and the separating wall separating liquid in the interior of the pump from the driving part, at least one bearing connected to the pump and supporting the driving part without contact on the separating wall, at least another bearing on the side of the pump blade wheel and located in an inner region of the pump housing, an inner ring fixed by the bearing on the blade wheel side, and an associated outer ring that rotates with the supported driving part.

28. A rotary pump according to claim 27, further comprising a roller bearing on the drive side, the roller bearing having the inner ring that rotates with the supported drive shaft, and the associated outer ring that is fixed.

* * * * *